US007695072B2

(12) United States Patent
Orgård

(10) Patent No.: US 7,695,072 B2
(45) Date of Patent: Apr. 13, 2010

(54) BOOM ARRANGEMENT FOR A SCALING DEVICE AND SCALING DEVICE

(75) Inventor: Jonas Orgård, Stöde (SE)

(73) Assignee: Atlas Copco Rock Drillas AB, Orebro (SE)

( * ) Notice: Subject to any disclaimer, the term of this patent is extended or adjusted under 35 U.S.C. 154(b) by 342 days.

(21) Appl. No.: 11/665,725

(22) PCT Filed: Oct. 6, 2005

(86) PCT No.: PCT/SE2005/001479

§ 371 (c)(1),
(2), (4) Date: Apr. 18, 2007

(87) PCT Pub. No.: WO2006/049544

PCT Pub. Date: May 11, 2006

(65) Prior Publication Data

US 2009/0121537 A1 May 14, 2009

(30) Foreign Application Priority Data

Nov. 3, 2004 (SE) ..... 0402669

(51) Int. Cl.
*E21C 27/24* (2006.01)

(52) U.S. Cl. ..... 299/69; 299/70

(58) Field of Classification Search ..... 299/69, 299/70; 212/300

See application file for complete search history.

(56) References Cited

U.S. PATENT DOCUMENTS

| | | | | | |
|---|---|---|---|---|---|
| 4,047,593 | A * | 9/1977 | Dammeyer | ..... | 182/2.8 |
| 4,243,107 | A * | 1/1981 | Shook | ..... | 173/193 |
| 5,407,252 | A | 4/1995 | Perero | | |
| 6,488,161 | B1 * | 12/2002 | Bean | ..... | 212/300 |
| 2006/0245895 | A1 * | 11/2006 | Horst et al. | ..... | 414/680 |

FOREIGN PATENT DOCUMENTS

| | | |
|---|---|---|
| SE | 365842 | 4/1974 |
| WO | 8202738 | 8/1982 |

* cited by examiner

*Primary Examiner*—John Kreck
(74) *Attorney, Agent, or Firm*—Mark P. Stone

(57) ABSTRACT

A boom arrangement (1) for a scaling device including a scaling boom for supporting a scaling hammer, wherein the scaling boom is arranged for connection to a carrier vehicle, is distinguished in that the scaling boom (4,5) is pivotally supported by a boom column unit (3), which is arranged for pivotal connection to the carrier vehicle, that the boom column unit (3)includes a boom column (7), and a column bar unit (8) extending at a distance from that element, that the boom column and the column bar unit are pivotally connected to a column link (9) for forming a four-link mechanism, and that the column link (9) supports a bearing for a boom lift cylinder (12). The invention also concerns a scaling device.

20 Claims, 4 Drawing Sheets

BOOM ARRANGEMENT FOR A SCALING DEVICE AND SCALING DEVICE

FIELD OF THE INVENTION

The invention relates to a boom arrangement according to the preamble of claim 1. The invention also relates to a scaling device including such a boom arrangement.

BACKGROUND OF THE INVENTION

Scaling means in rock engineering clearing and loosening of loose rock after for example blasting in tunnelling, drifting etc. A known equipment for mechanized scaling includes a carrier vehicle, whereon is arranged a rotatable and pivotable scaling boom having an outer pivotal arm, at the free end of which is pivotally arranged a percussive hammer.

When performing the scaling operation with the known equipment, the operator is directing the hammer against the surfaces to be worked on by controlling the hydraulic cylinders of the boom arrangement. This means relatively complicated control work, since the operator has to control and compensate the different cylinders of the unit in dependent of the position of the boom with respect to the carrier vehicle. In practice, therefore, long term training is required for the operator to be able to handle the equipment at least somewhat efficiently with good precision.

One of the reasons for this is that the character of the scaling work is such that the equipment needs to be very robust and that different types of sensors are undesired. A solution with program control has therefore not been considered to be sufficiently reliable in the environment which prevails where the equipment is to be used. This is because the equipment constantly risks to be subjected to falling stones and even stone blocks.

Even if the above mentioned known scaling device is operated by an experienced and trained operator, its drawbacks lead to slow and thereby uneconomic procedure.

Aim and Most Important Features of the Invention

It is an aim of the present invention to provide a boom arrangement for a scaling device which allows better possibilities of control, and thereby provides provisions for more efficient and more economic scaling. This aim is achieved in a boom arrangement of the above mentioned kind through the features of the characterising portion of claim 1.

Hereby is achieved a boom geometry which allows an essentially more advantageous motion of the hammer essentially irrespective of which position the boom is standing in. In any case this concerns the positions that define the working area of the equipment. The greatest part of the scaling is typically performed in the roof of the space to be scaled, which means that a natural, horizontal movement of the hammer along the roof, which is achieved through the invention, is very suitable.

It is achieved through the invention with the pivoting of the boom column, an essentially horizontal movement of the hammer along a considerable length of the movement. According to the known art there is no corresponding horizontal movement achieved whatsoever. The small vertical movement which occurs because the upper end of the boom column, as well as the hammer itself, moves along a circular arch, can be essentially neglected in relation to the considerable horizontal movement which occurs in operation. The small vertical movement is very easily compensated for by the operator.

By it being so that the boom lift cylinder is positioned below the scaling boom, said cylinder is protected from falling stones.

Even if the invention is particularly advantageous for scaling work along horizontal surfaces such as tunnel roofs etc. it is also advantageously applicable for scaling on vertical surfaces such as tunnel walls etc. In this regard the invention is not inferior in comparison with the known art.

A scaling equipment as intended here works in a very unusual environment. It is common that very large pieces of rock falls down on the boom during operation. Through the invention, the boom lift cylinder will be protected against such pieces of rock to a high extent while maintaining the very advantageous working geometry which is provided by the further features of claim 1.

The central position of the cylinder which is made possible through the invention also brings along possibilities of enhanced view for the operator and enhanced rigidity for the boom.

The latter is of particular importance for scaling work sideways, when torsional stiffness is of great importance, which the forked embodiment allows.

It is preferred that the boom column and the column bar unit are essentially parallel and it is particularly preferred that the four-link mechanism forms a parallelogram. Hereby the lower pivot axes for the boom column and the column bar unit are preferably at the same horizontal level, whereby also the pivot axes of the column link formed with the boom column and the column bar unit are also positioned essentially on the same horizontal level for achieving said parallel displacement of the hammer.

When the support arm or the corresponding element is made in one piece with the column link, a stable and robust construction of these elements is achieved.

The boom column is preferably constructed with an enlarged lower portion having sideways considerably separated bearings for achieving the required sideways stability. In order to achieve the necessary stiffness of the boom column, that element has a section with at least partially U-shaped, or rectangular closed section.

Suitably the boom column is constructed such that with retracted boom column, the support arm or the corresponding element is retracted into a space formed in the upper portion of the column. This gives the possibility of a compact construction.

The corresponding advantages are obtained in connection with a scaling device according to claim 16.

Further features and advantages will be evident from the following detailed description of embodiments.

BRIEF DESCRIPTION OF DRAWINGS

The invention will now be described by way of embodiments and with reference to the annexed drawings, wherein.

DESCRIPTION OF EMBODIMENT

Figure 1:
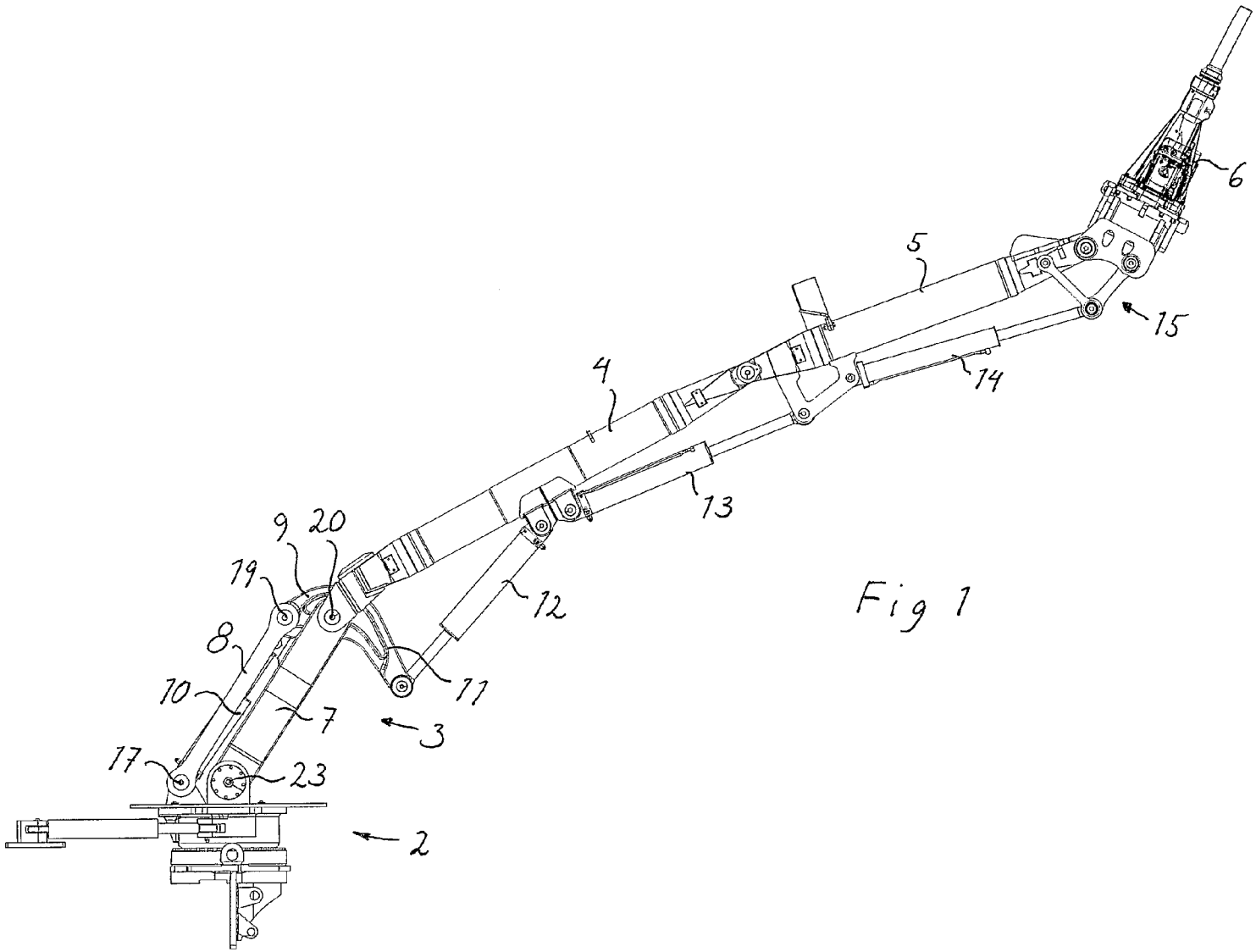
FIG. 1 shows a boom arrangement according to the invention in a side-view in a first position.

FIG. 1 shows a boom arrangement 1 for a scaling device to be supported by a not shown supporting vehicle. The boom arrangement 1 includes a rotation unit 2 with rotation cylinders, a boom column unit 3, an inner boom portion 4, an outer boom portion 5 and a scaling hammer 6. Between these components are arranged essentially parallel pivot joints, so that pivoting can be performed in a vertical plane that is in common for the components.

For that purpose the boom column unit 3 is comprised of a boom column 7 and a column bar unit 8 which is parallel thereto and has the same length. At their outer ends, these components are pivotally joined over a horizontal column link 9 for forming a four-link mechanism. This is pivotable for angular variation by means of a column cylinder 10.

The column link 9 has an obliquely downwardly angled integral continuation in the form of a support arm 11, which at its outer region is provided with a bearing in the form of an inner pivot point for an inner boom lift cylinder 12, the outer pivot point of which being positioned on the inner boom portion 4. In the same area of the inner boom portion, there is arranged a first pivot point for an outer boom lift cylinder 13, the second pivot point of which being positioned at the outer boom portion 5. Finally, the swinging movement of the scaling hammer 6 with respect to the outer boom portion 5 is controlled by means of a per se known arrangement with a hammer positioning cylinder 14 and a pivot link system 15.

Figure 2:
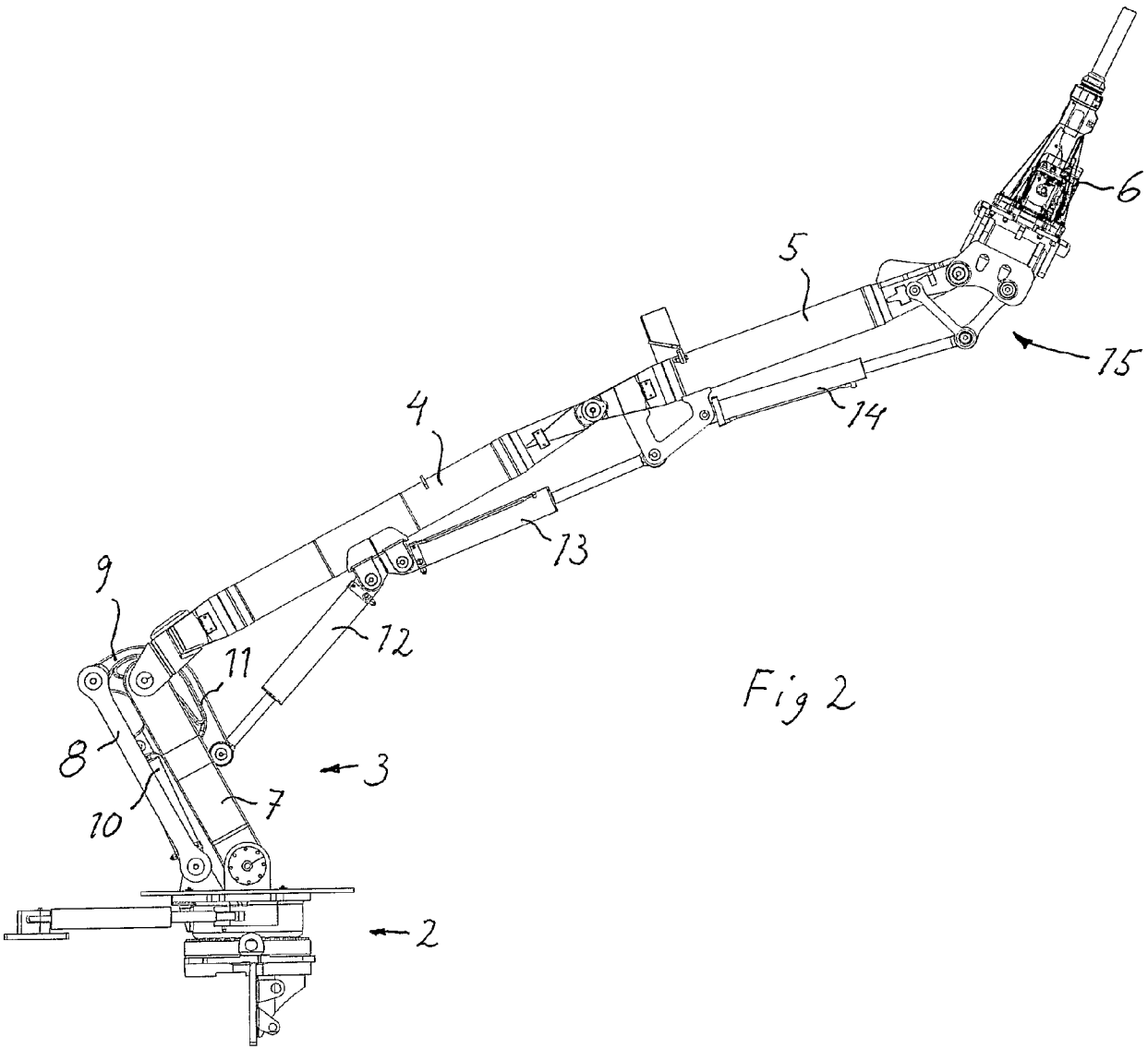
FIG. 2 shows the boom arrangement in FIG. 1 in a side-view in a second position.

In FIG. 1, the boom arrangement is shown in an advanced position with the boom column unit 3 obliquely forward that is in the direction of the boom portions of the boom arrangement. In FIG. 2, the boom arrangement is shown in a second position, wherein the boom column unit 3 is in a retracted position that is angled in a direction from the boom portions 4 and 5.

In normal scaling the operation is usually performed between the positions shown in FIG. 1 and 2. The pivoting of the boom column unit between these positions results in a nearly horizontal parallel displacement of the scaling hammer 6.

Figure 3:
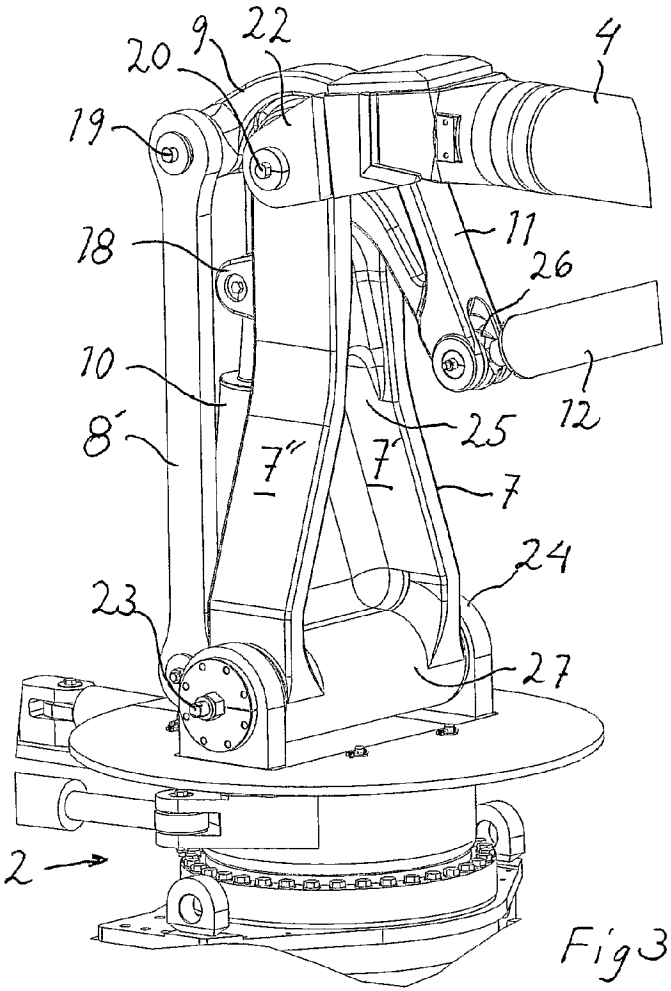
FIG. 3 shows in a perspective view in enlarged scale the boom column of the boom arrangement in FIGS. 1 and 2.
Figure 4:
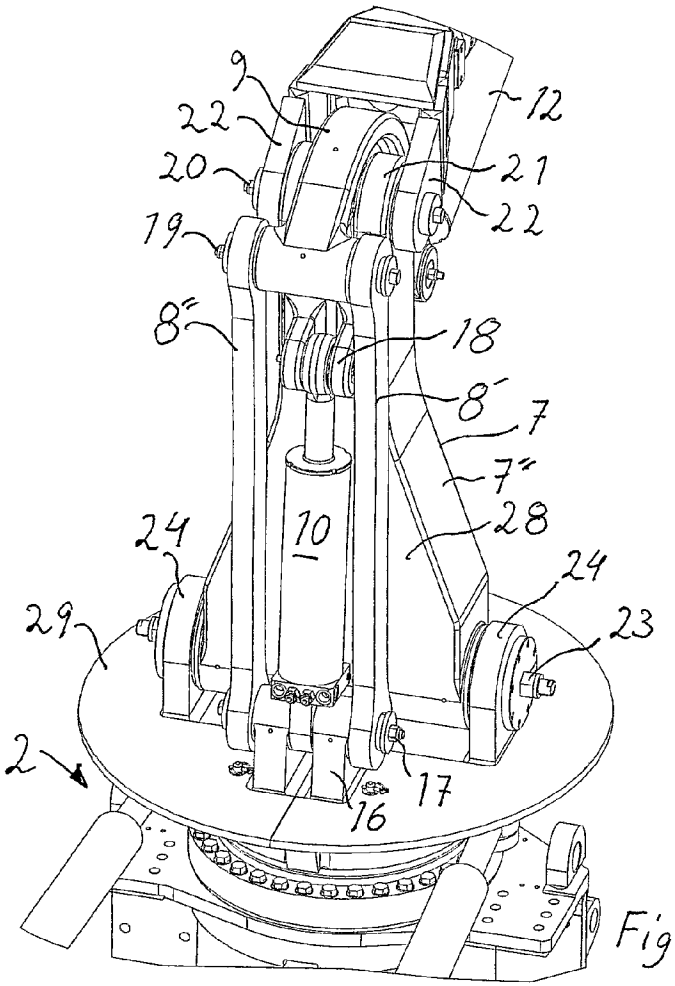
FIG. 4 shows the boom column in a second perspective view.

In FIGS. 3 and 4, the boom column unit is shown in greater detail, wherein the boom column 7 is shown with a section that is essentially U-shaped along the extension of the column link, that is two side portions 7' and 7" extend from a sideways separated lower pivot point and upwardly obliquely towards each other. They are joined after essentially their entire lengths on one side by a stiffening rear portion 28.

Through an upper covering 29 for the rotation unit 2, for example a metal plate or a robust rubber cloth, bearing means 16 extend for carrying pivot means at 17 for on the one hand bars 8' and 8" comprising the column bar unit 8, on the other hand the column cylinder 10 for controlling the pivoting of the four-link mechanism forming the boom column unit. The column cylinder 10 engages in pivot means 18 with the boom column 7 at the upper region of that element.

At the upper ends of the bars 8' and 8" these elements are pivotally connected to the column link 9 at the pivot means 19, at each side thereof. The column link is in turn at pivot means 20 in pivotal engagement with a forked upper end 21 of the boom column 7 for enclosing the column link in that position. Further, at that pivot means 20, there is also pivotally joined the inner end of the inner boom portion 4 through bearing ears 22.

The boom column 7 has, according to the above, a construction with an open side, which is turned towards the general operational area of the boom arrangement. This space is shaped and dimensioned such that the support arm 11 has a possibility of being retracted within the boom column in the retracted position (FIG. 2) of the boom column unit 3. This gives an advantageous compact arrangement.

At its lower end, the support arm 11 has a forked construction for receiving the lower bearing attachment of the inner boom lift cylinder 12.

Altogether, the column link 9 provides a shallow C-shape for forming a curved beam having an I-, H- or T-shaped section along central parts of its extension. The boom column 7 has for stability and rigidity reasons a spread base, with the side portions 7' and 7" and the rear portion 28 adjoining to a cylindrical body portion 27, which has means for cooperation with pivot means at 23 with pivot bearings positioned in bearing ears 24, extending from the rotational unit 2. For further stiffening of the boom column it can, at least along the part of its extension, have a closed, essentially rectangular section.

Figure 5:
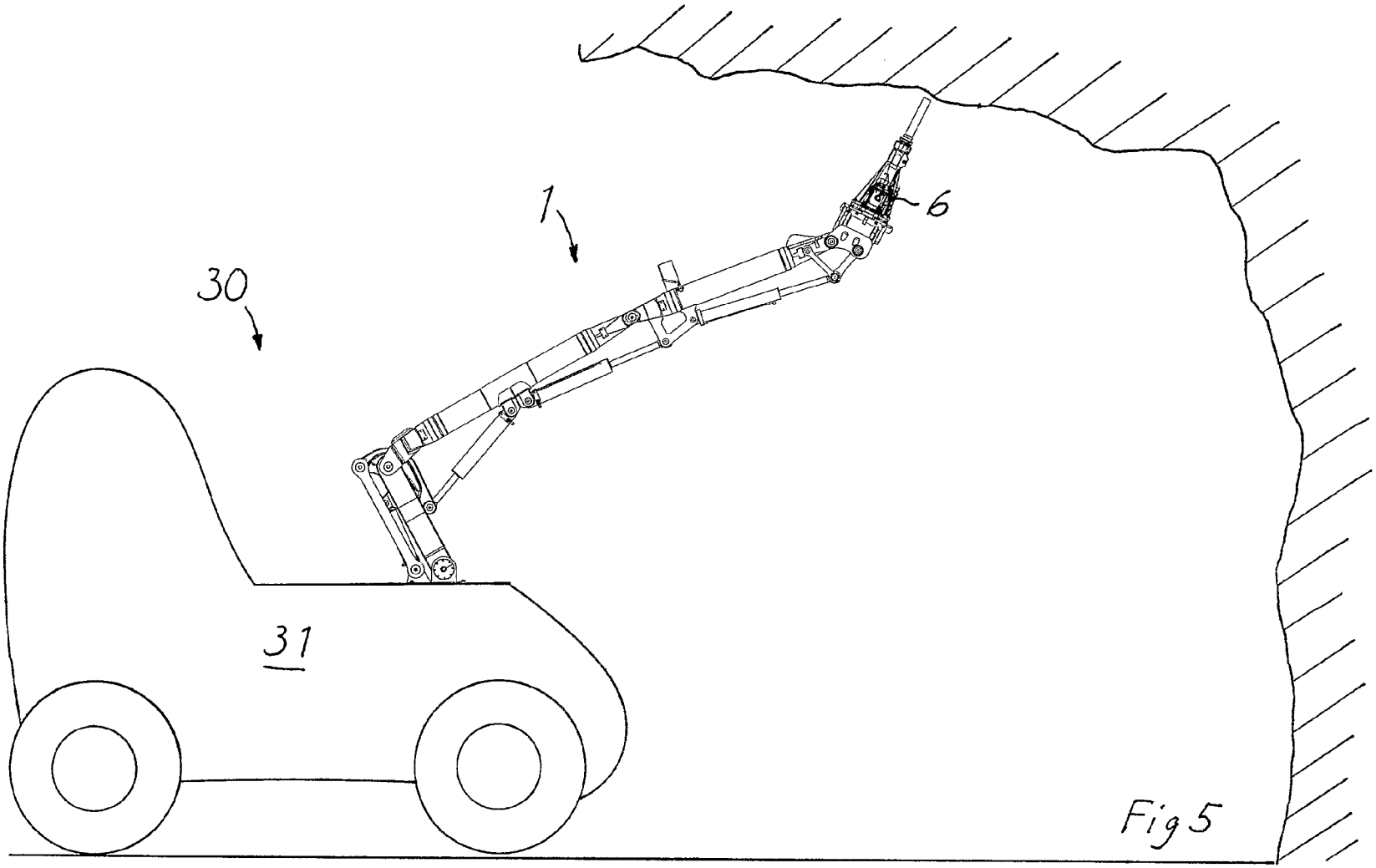
FIG. 5 shows diagrammatically a scaling device according to the invention.

In FIG. 5 there is diagrammatically shown a scaling device 30 with includes a carrier vehicle 31 and a boom arrangement 1 for working at the inside of a blasted tunnel.

The invention can be modified within the scope of the following claims. The four-link mechanism can thus deviate from being a parallelogram even if this is not preferred. It is further preferred that the boom arrangement has been constructed in such a way that hydraulic cylinders, joints etc. are protected as much as possible from falling stones. For that reason the arrangement shown in FIGS. 1 and 2 is preferred, having the cylinders positioned below the boom components. It is, however, not excluded that the cylinders are positioned otherwise.

The boom column unit 3 can be modified as to its construction and as an example the boom column 7 and the column bar unit 8 can be constructed more similar to each other. It should, however, be noted that the shown construction with a boom column essentially receiving rotational forces and pressing forces, and bars, that receive tensional forces is preferred. The column bar unit can also have a protection for the column cylinder against falling stones. Boom portions can be disposed otherwise and the scaling hammer can also be arranged otherwise, even if the shown arrangement is preferred.

The construction with the support arm which is in one piece with the column link can be modified to be comprised of a unit having another construction, for example a metal structure of for example a metal plate which is constructed in such a way that the bearing for the boom lift cylinder is positioned on an element which is not comprised of a "arm" but instead for example of a portion of a unit having larger dimensions in the width direction, that is generally transversal to its general length extension as it is shown in the figures, in order to increase its rigidity.

The invention claimed is:

1. Boom arrangement (1) for a scaling device including a scaling boom for supporting a scaling hammer, wherein the scaling boom is arranged for connection to a carrier vehicle, wherein:

the scaling boom (4, 5) is pivotally supported by a boom column unit (3), which is arranged for pivotal connection to the carrier vehicle, the boom column unit (3) includes a boom column (7), and extending at a distance from that element, a column bar unit (8), the boom column and the column bar unit are pivotally connected to a column link (9) for forming a four-link mechanism, the column link (9) supports a bearing for a boom lift cylinder (12), the bearing for the boom lift cylinder (12) is positioned for carrying a boom lift cylinder (12) which is positioned below the scaling boom (4, 5) in operation, the boom column (7) is provided with a forked outer end portion (22) for pivotally enclosing the column link (9), and the scaling boom (4, 5) is pivotally joined to the four-link mechanism in a pivot means (20) connecting the boom column (7) and the column link (9).

2. Boom arrangement according to claim 1, wherein the column link (9) is rigidly connected to a support arm (11), over which the bearing of the boom lift cylinder (12) is supported.

3. Boom arrangement according to claim 1, wherein the boom column and the column bar unit are essentially parallel.

4. Boom arrangement according to claim 1, wherein the four-link mechanism forms a parallelogram.

5. Boom arrangement according to claim 1, wherein a portion of a unit including the bearing of the boom lift cylinder (12) is made in one piece with the column link (9).

6. Boom arrangement according to claim 1, wherein the column bar unit (8) includes a bar (8', 8") on each side of the column link (9).

7. Boom arrangement according to claim 1, wherein a column cylinder (10) is arranged for varying the angles of the four-link mechanism.

8. Boom arrangement according to claim 1, wherein a protection for the column cylinder (10) is arranged in the area of the column bar unit (8).

9. Boom arrangement according to claim 1, wherein the boom column (7) is constructed with a widened lower portion as seen axially for its lower pivot axis with more separated bearings than it is provided with in a tapering upper portion.

10. Boom arrangement according to claim 1, wherein the boom column (7) has a section with at least partially essentially U-shaped or rectangular, closed section.

11. Boom arrangement according to claim 1, wherein the scaling boom includes two mutually pivotally interconnected portions.

12. Boom arrangement according to claim 1, wherein the actuating cylinders for all functions of the boom arrangement are positioned in protected positions below the scaling boom in operation.

13. Boom arrangement according to claim 1, wherein the boom column unit (3) is supported by a rotational unit (2) which in turn is arranged for connection to the carrier vehicle.

14. Scaling device (30) including a carrier vehicle (31), a scaling hammer (6) and a boom arrangement (1) according to claim 1.

15. Boom arrangement according to claim 2, wherein the boom column and the column bar unit are essentially parallel.

16. Boom arrangement according to claim 2, wherein the four-link mechanism forms a parallelogram.

17. Boom arrangement according to claim 3, wherein the four-link mechanism forms a parallelogram.

18. Boom arrangement according to claim 15, wherein the four-link mechanism forms a parallelogram.

19. Scaling device (30) including a carrier vehicle (31), a scaling hammer (6), and a boom arrangement (1) according to claim 2.

20. Scaling device (30) including a carrier vehicle (31), a scaling hammer (6), and a boom arrangement (1) according to claim 3.

* * * * *